US006030582A

United States Patent [19]

Levy

[11] Patent Number: 6,030,582

[45] Date of Patent: Feb. 29, 2000

[54] SELF-RESEALING, PUNCTURABLE CONTAINER CAP

[76] Inventor: Abner Levy, 325 N. Oakhurst Dr., P4, Beverly Hills, Calif. 90210

[21] Appl. No.: 09/036,578

[22] Filed: Mar. 6, 1998

[51] Int. Cl.[7] ..... B01L 3/00; B65B 41/20

[52] U.S. Cl. ..... 422/99; 422/100; 422/102; 436/180; 600/573; 600/577; 215/247; 215/296; 215/303; 215/349; 215/350

[58] Field of Search ..... 422/99, 100, 102; 436/180; 600/573, 577; 215/232, 247, 249, 296, 297, 299, 303, 349, 350

[56] References Cited

U.S. PATENT DOCUMENTS

| | | | |
|---|---|---|---|
| 2,436,291 | 2/1948 | Daniel | 15/257.05 |
| 3,629,873 | 12/1971 | Long | 4/220 |
| 4,515,752 | 5/1985 | Miramanda | 422/99 |
| 4,762,248 | 8/1988 | Uhlig | 206/508 |
| 4,852,560 | 8/1989 | Hermann, Jr. et al. | 600/575 |
| 4,868,130 | 9/1989 | Hargreaves | 436/526 |
| 4,927,605 | 5/1990 | Dorn et al. | 422/102 |
| 4,934,547 | 6/1990 | Mayes et al. | 215/306 |
| 4,981,144 | 1/1991 | Carels, Jr. | 600/573 |
| 5,088,612 | 2/1992 | Storar et al. | 215/247 |
| 5,119,830 | 6/1992 | Davis | 600/584 |
| 5,128,104 | 7/1992 | Murphy et al. | 422/102 |
| 5,202,093 | 4/1993 | Cloyd | 422/102 |
| 5,257,984 | 11/1993 | Kelley | 604/403 |
| 5,270,211 | 12/1993 | Kelln et al. | 436/43 |
| 5,328,041 | 7/1994 | Hook et al. | 215/247 |
| 5,429,803 | 7/1995 | Guirguis | 422/58 |
| 5,569,225 | 10/1996 | Fleury | 604/323 |
| 5,595,187 | 1/1997 | Davis | 600/584 |
| 5,601,191 | 2/1997 | Meador | 206/569 |
| 5,647,939 | 7/1997 | Gee et al. | 156/272.6 |
| 5,651,940 | 7/1997 | Buonaiuto et al. | 422/102 |
| 5,904,677 | 5/1999 | Drummey et al. | 604/415 |
| 5,913,232 | 6/1999 | Betts et al. | 436/11 X |

*Primary Examiner*—Maureen M. Wallenhorst
*Attorney, Agent, or Firm*—Natan Epstein; Beehler & Pavitt

[57] ABSTRACT

A self-resealing container cap configured to make a closing engagement with a container and a septum of elastomeric material supported in an opening defined by the cap periphery. The septum is puncturable by a blunt tip of an instrument such as a disposable plastic pipetter tip or a single use plastic laboratory transfer pipette having a tip width substantially greater than the thickness of a central portion of the septum. The septum is further configured to be substantially self-resealing against significant leakage of specimen liquid through the septum following withdrawal of the blunt tip from the punctured septum.

19 Claims, 2 Drawing Sheets

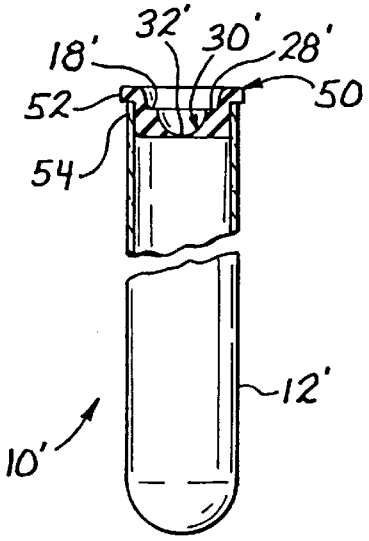
FIG. 5
FIG. 6
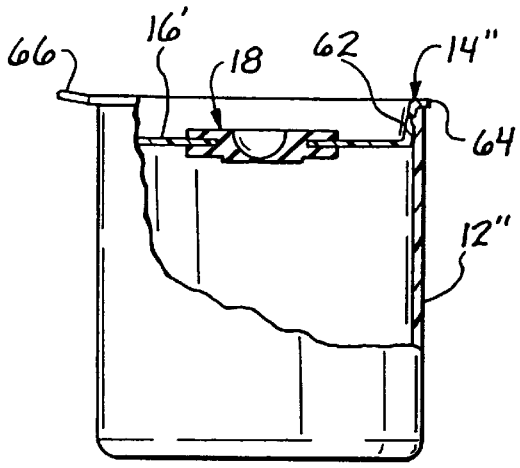
FIG. 7
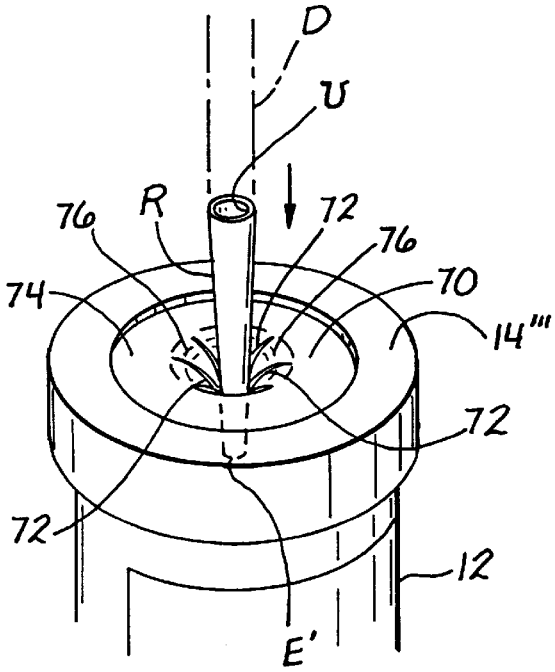
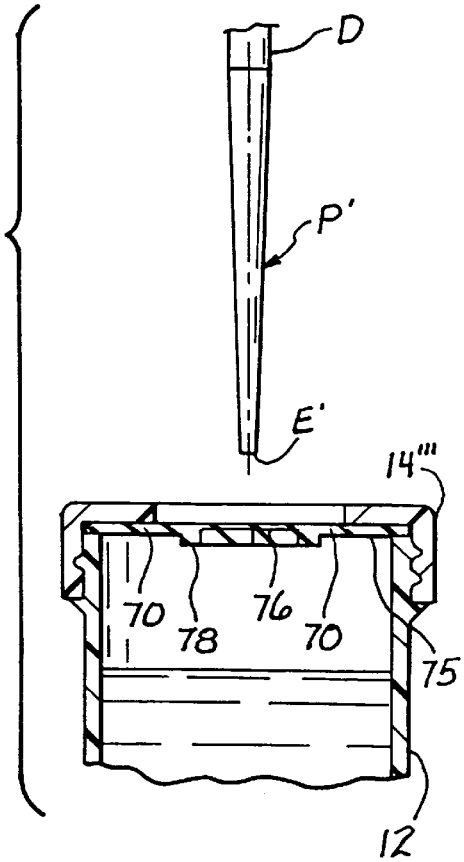
FIG. 8

SELF-RESEALING, PUNCTURABLE CONTAINER CAP

BACKGROUND OF THE INVENTION

1. Field of the Invention

This invention relates to the field of clinical laboratory practices and to specimen containers used in the collection and handling of medical urine specimens.

2. State of the Prior Art

Urine specimens are collected routinely during medical examinations in both outpatient and clinical settings. The individual specimen s once collected at the direction of an attending physician is forwarded to a clinical laboratory location which typically is remote from the specimen collection site.

In a typical collection procedure, a specimen container is handed to the patient, who then deposits the specimen in privacy. The container vessel frequently has a screw-on cap which may be replaced by the patient after depositing the specimen. The closed container is then handed to a nurse or other medical attendant, who arranges for transfer of the container to the laboratory location. The laboratory location may be in the same building or complex, in the case of a hospital, or may be at a considerable distance across town or even in another city if the specimen was taken at a physician's private office. In either case, some transport of the specimen container is involved, during which it is important to safeguard the specimen against contamination while avoiding any leakage of the specimen liquid from the container. Both these objectives call for a reliable liquid tight seal between the cap and the container.

When received at the clinical location, the specimen container is transferred to a laboratory technician who draws a sample from the clinical specimen in the container. The sample is then subjected to the analytical procedure requested by the attending physician.

The current practice in clinical laboratories is to draw the analytical sample from the specimen container by means of a single use plastic pipet. This pipet is similar to an eye dropper in that it includes a squeeze bulb attached to the upper end of a holding tube, the lower end of which is drawn out to form an elongated tip portion of reduced diameter terminating in an open tip end. The laboratory technician opens the container by manually unscrewing or otherwise removing the container cap, introduces the tip of the pipette into the open container vessel, immerses the tip in the liquid specimen, and aspirates the analytical sample into the holding tube by squeezing and releasing the bulb of the pipet.

The plastic transfer pipets normally used for this purpose are intended to be used only once and discarded after that single use to prevent cross contamination of successive specimens processed in the laboratory. In the interest of economy, these pipets are therefore molded in a relatively flexible, soft thermoplastic material which permits the squeeze bulb to be formed integrally with the holding tube and the drawn out tip. The result is that the tip portion of the pipet is rather flexible and is readily bent sideways. A typical transfer pipet of this type has a holding tube which is 2.5" in length by approximately ¼" in diameter, a tapering portion approximately 1 and ⅛" in length at the lower end of the holding tube, terminating in a tip portion 1" in length and approximately ⅛" in outside diameter. The tip opening is approximately circular and the tip end is cut square or perpendicular to the longitudinal dimension of the tip portion. At the upper end of the holding tube, the squeeze bulb is approximately 1.25" in length and about ½" in diameter. The holding tube portion of the pipet can be squeezed flat between two fingers with little effort, and the thinner tip section can be bent sideways very easily, tending to return to a generally straight original condition when released. The wall of the tip portion at the tip opening is about 1/32" in thickness. If the pipet is grasped at its mid-portion, along the holding tube portion, and the tip end is pressed against a hard surface, the tip portion of the pipet bends sideways with the application of little manual force applied axially along the pipet and normally to the hard surface. These single use soft plastic transfer pipets are widely used in clinical laboratories and have proven adequate in regard to economics and functionality for their intended purpose.

Some clinical laboratories prefer to use pipetters with disposable tips. Pipetters are syringe-like devices with a plunger which, when depressed, draws a measured, preset amount of fluid into the barrel to the pipetter through a plastic tip fitted onto the end of the pipetters draw tube. The tip can be ejected from the pipetters by pressing a handle or lever provided for this purpose, without the user touching the tip. A new plastic tip is then fitted onto the pipetter for drawing the next sample, and avoid cross-contamination between successive samples. Such pipetters are widely used in laboratories and are available from many different manufacturers. The disposable plastic tips for the pipetters typically are of elongated conical shape, tapering to a circular tip opening. The open tip end is cut across the long axis of the tip to form a blunt tip end which presents the full thickness of the tip wall transversely to that axis. The open tip end diameter may be about 3/32ds of an inch, with a tip opening of about 1/32nd inch. The length of the disposable tip may be about 3⅜ths inch and the top end about 5/16ths inch.

The open tip end of a disposable plastic pipetter tip may be of comparable dimension to the open tip end of a single use disposable sampling pipette, the main difference being that the plastic pipetter tip is relatively stiff and does not flex readily sideways when pressed against a firm surface.

Clinical urine samples are processed and analyzed in large numbers, with larger clinical laboratories handling thousands of such samples every day. Currently, each of the specimen containers must be manually opened by laboratory personnel in order to draw the analytical samples. Opening and recapping of many such containers constitutes a substantial component of the total labor involved in processing the clinical specimens at the laboratory. Also, the repetitive motion involved in unscrewing and replacing the caps has been known to stress the hand and wrist of laboratory personnel to the point of disability. Furthermore, the open specimen containers pose a risk of contamination of specimens, contamination of the laboratory environment, loss of specimens through accidental spillage, and possible infection of personnel.

It is therefore desirable to provide a method for handling and processing urine and other similar liquid medical specimens which eliminates the need for opening and closing the specimen containers at the clinical laboratory location. It is further desirable to accomplish this objective with a minimum of change and disruption to existing equipment, supplies and procedures to which laboratory personnel have grown accustomed. In particular, it is desirable to provide specimen containers which can be accessed without uncapping with either the disposable plastic pipetter tips or the disposable plastic transfer pipets currently in widespread use.

Once an analytical sample is drawn from the urine specimen container, the container with the remaining specimen material is either discarded, if no further need for the material is contemplated, or is frozen for storage against the possible need for additional future analysis of the remaining specimen material. For this reason, it is also important that the closed specimen container maintain an effective seal against spillage and significant leakage during such handling and storage even after an initial sample has been taken of the liquid contents.

Many vials and containers are available with closures, such as a septum of elastomeric material, which are penetrable by a sharp pointed metal needle such as a hypodermic needle, and which maintain a good seal after being pierced by the needle. Those closures, however, cannot be penetrated with relatively blunt tip ends such as those found on either disposable plastic pipetter tips or on soft plastic single-use plastic pipets.

No containers are known having an elastomeric septum puncturable by such implements and which is also self-resealing following such puncture in order to restore a sufficiently effective liquid tight seal for safe handling and storage of the remaining specimen material at the clinical laboratory location.

For these and other reasons, improvement is needed in the specimen containers used for this purpose and in the handling of the clinical urine specimens.

SUMMARY OF THE INVENTION

In response to the aforementioned need, the present invention provides an improved specimen container for collecting and transporting medical liquid specimens, particularly urine specimens. Also disclosed is a method of handling specimens using the improved container.

The improved specimen container has a container vessel with an open container vessel top, and a container cap which can be manually removably engaged to the container vessel for making a liquid tight closure with the vessel top. The container cap has a septum of elastomeric material selected and configured to be puncturable by the relatively blunt tip of a disposable plastic pipetter tip or by a single use soft plastic laboratory transfer pipet driven with manual force against the septum in order to introduce the tip into the capped container for drawing an analytical sample of the urine specimen. The elastomeric material is further selected and configured to be substantially self-resealing against significant leakage of specimen liquid through the septum following withdrawal of the pipet tip from the punctured septum.

That is, the elastomeric septum of this invention has two main characteristics. One chief characteristic of the elastomeric septum according to this invention is that it is puncturable by tubular sampling implements having relatively blunt open tip ends which cannot pierce the relatively hard rubber septa typically used in drug vials and on the sterile glass tubes commonly used for drawing clinical blood samples. These hard rubber septa can be pierced with sharp metallic needles, but cannot be punctured with any known plastic tubular sampling implement and in particular cannot be punctured by a disposable plastic pipetter tip nor a disposable soft plastic transfer pipette. In general, the septum of this invention is puncturable by relatively wide diameter liquid sampling instruments, of plastic, metal or other material, which do not have a sharp needle point at the tip of the type used for piercing conventional harder rubber septa. By blunt tip end is meant any tip end which is not cut at a slant to form a sharp needle point.

A second chief characteristic of the novel septum is the septum's ability to substantially self-reseal following puncture by such a relatively blunt and relatively wide diameter tubular sampling implement, to a resealed condition where the septum is substantially closed against spillage during normal handling of the specimen container on the laboratory premises following puncture of the septum by a sampling implement.

The resilient material of the puncturable septum may be a silicone rubber, configured so as to define a relatively thick peripheral portion about a central portion of reduced thickness. The thicker peripheral portion is not readily puncturable by the transfer pipet tip while the portion of reduced thickness can be readily punctured with that tip by application of little or moderate manual force to the sampling implement.

The container cap may be entirely made of the resilient material which defines the septum, or the cap may have a rim of relatively hard material with the septum of puncturable resilient material supported in an opening in the cap. The container cap may be configured to make a snap fit or press fit with the container top, or alternatively may be threaded for screwing on the container vessel top, in either case making a liquid tight seal with the container vessel. In the case where the container cap includes an outer rim of hard plastic, for example, the puncturable septum preferably has a diameter no greater than one-half the diameter of the hard outer portion.

The central portion of reduced thickness of the septum may be a dimpled portion gradually diminishing in thickness from the relatively thick peripheral portion to a minimum thickness. Alternatively, one or more slits may be cut partially through the thickness of the septum in order to define a weakened portion, effectively of reduced thickness which is more readily puncturable by the blunt ended tip of the sampling implement than a remaining relatively thick portion of the septum.

This invention also includes an improved method of processing clinical urine samples, using the improved specimen container also disclosed herein. The improved method includes the steps of providing to the specimen donor an improved specimen container according to this invention. The specimen donor deposits a urine specimen in the open specimen container, and the container is closed by replacing the container cap to make a liquid tight seal with the container vessel top. The sealed container with the urine specimen is then conveyed to the laboratory location. There, the tip of a relatively blunt generally tubular sampling implement such as a disposable plastic tip for a pipetter or the tip of a single use soft plastic transfer pipet, is manually pressed against the septum with sufficient force to puncture and penetrate through the septum into the container. An analytical sample of the urine specimen is then drawn into the sampling implement, and the tip of the implement is withdrawn to allow the septum to substantially reseal itself. According to this method, the urine specimen is sampled for analysis without opening the closed specimen container once it has been closed at the specimen collection site. After taking of the analytical sample, the specimen container with the remaining urine specimen material may be placed in cold storage against possible future need for additional analytical samples of the same clinical specimen, or discarded if no further analysis is anticipated.

The improved specimen container of this invention can also be used advantageously with auto sampling analyzers of the type having one or more metal pipets for dipping into a liquid specimen in a specimen container, aspirating an analytical sample of the liquid specimen, and transferring the aspirated sample for analysis. In such case, the closed specimen container containing the clinical specimen is submitted to the analyzer for automated puncturing of the septum in the specimen container by the metal pipet without first removing the container cap. After the analyzer automatically withdraws the pipet from the septum, the elastomer material of the septum substantially self-reseals the puncture. As a result, analytical sampling of the clinical specimen is performed by the automated machine without removing the container top from the container vessel.

These and other advantages, improvements and features will be better understood by reference to the following detailed description of the preferred embodiments taken in conjunction with the accompanying drawings.

BRIEF DESCRIPTION OF THE DRAWINGS

FIG. 5 is a side view partly in section of a vial with an elastomeric press-fit closure provided with an integral elastomeric septum according to this invention;

FIG. 6 is a side view partly in section of a specimen container with a press-fit container cap, the cap having an elastomeric septum as in FIGS. 2 and 3;

FIG. 7 is a top side perspective of a specimen container having a cap with an elastomeric septum punctured by a transfer pipet, the septum having a puncture area defined by cuts in the septum material to define a weakened point puncturable by the transfer pipet; and FIG. 8 is a cross sectional view of the container cap of FIG. 7 showing the septum before puncturing with the transfer pipet.

DETAILED DESCRIPTION OF THE PREFERRED EMBODIMENTS

Figure 1:
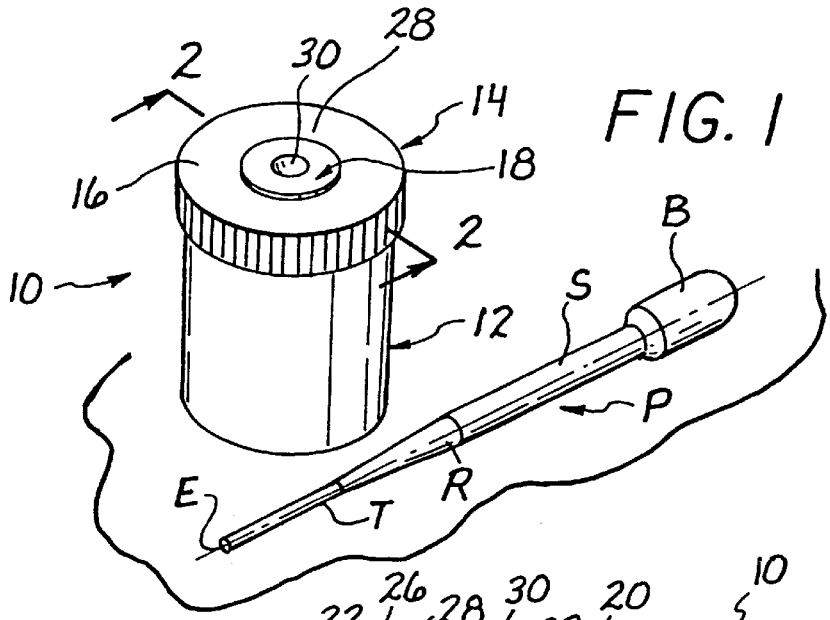
FIG. 1 illustrates in perspective view a specimen container improved according to this invention and a typical single-use plastic transfer pipet of the type suitable for sampling the contents of the container through the puncturable septum.

With reference to the accompanying drawings in which like elements are designated by like numerals, FIG. 1 shows an improved specimen container generally designated by the numeral 10. The specimen container, which is cylindrical for purposes of example only, includes a cylindrical container vessel 12 and a container cap 14 fitted to the open top 15 of the vessel 12 to make a liquid-tight seal with the container vessel, as better seen in FIG. 2. The cap 14 has a radially outer or peripheral rim portion 16 made of a relatively hard material, for example a relatively stiff thermoplastic such as polyethylene, and a centrally disposed septum 18. The peripheral portion of cap 14 also includes an annular dependent wall 36 interiorly threaded for screwing onto a mating exterior thread 38 just below the open top 15 of the vessel. The threading is such that a liquid-tight seal can be achieved by tightening the cap against the vessel top. Generally, the choice of material for the container vessel 14 and peripheral cap portion 16 is not critical, and both may be of any suitable injection molded thermoplastic.

The specimen container 10 is intended for use in conjunction with commercially available sampling or transfer pipets such as the pipet P in FIG. 1. Pipet P has a midportion consisting of holding tube S, a squeeze bulb B integrally formed with the upper end of the holding tube S, a tapering transition R extending from the lower end of the holding tube S and a tip portion T of relatively small, approximately constant diameter. The tip portion T terminates in a tip end E which is square-cut with the longitudinal dimension of the tip portion, i.e., is not cut at an angle to define a needle point. The entire pipet is integrally molded in one piece together with the squeeze bulb attached to the holding tube. The need to provide flexible walls on the bulb to permit squeezing also results in a relatively flexible holding tube S. The smaller diameter tip portion T is particularly flexible and bends sideways with little force, for example, when the tip end E is pressed against an unyielding surface. Single-use soft-plastic transfer pipets of this type are widely used in clinical laboratories and commercially available from many manufacturers, such as Corning Samco, located at 1050 Arroyo Ave., San Fernando, Calif. 91340. The transfer pipets from this and other sources are available in a range of overall and fluid capacities, and with varying lengths of the small diameter tip section T. For purposes of this invention, pipets having relatively long tip sections T are preferred since it is desirable for the tip end E to reach well into the specimen container after puncturing the septum, so that most of the clinical specimen volume can be drawn, if necessary. Such extended small diameter tips are quite flexible and are sold with blunt, square cut tip ends. These pipet tips were never intended for puncturing a container cap, and prior to this invention have never been used in that manner. As mentioned earlier, the accepted procedure in clinical laboratories is to manually open the urine specimen containers, draw the analytical sample with the pipet, and then manually recap the container. It is therefore an important feature of the specimen container 10 with puncturable septum according to this invention that use is made of the existing single-use soft plastic pipets, which are well known to the clinical laboratories and which are widely available from many established vendors. Furthermore, the same pipets P may be used with clinical specimens handled in the conventional manner, i.e., by opening and closing the specimen containers, as well as with the novel specimen container disclosed herein. The ability to use the same pipets for both methods simplifies operation of the clinical laboratory, if specimens are received in mixed containers, some requiring opening and others puncturable with the pipet. It also enables implementation of the improved specimen containers by a laboratory with a minimum of inconvenience and expense, while deriving immediate benefit in reduced labor cost and diminished risk of contamination.

The septum 18 is made of an elastomeric material, such as a silicone rubber, and is supported in a central hole 20 defined in the cap 14. For example, an interference fit is formed by radially overlapping exterior and interior septum portions 22, 24 between which is captive the inner cap edge 26. The septum 18 in its presently preferred form has a peripheral portion 28 which is relatively thick, and a central portion of reduced thickness which in the illustrated example is a generally spherical dimple or dished area 30 in the upper or exterior surface 34 of the septum. The thickness of the septum reaches a minimum at and near the center 32 of the dimple 30. The width or radius of this central dimple area 32 having the minimum thickness is approximately equal or slightly greater than the outside diameter of the tip E of transfer pipet P to be inserted through the septum 18.

That is, the area of the dimple which is readily perforable by the pipet tip end is not much wider that the outside diameter of the tip end, and is surrounded by a transitional dimple area 33 of rapidly increasing thickness. The dimple 30 is itself surrounded by the peripheral portion 28 of the septum which is of much greater thickness than the perforable area 32 of the dimple and which cannot be perforated by the pipet tip E in any practical-manner.

Figure 3:
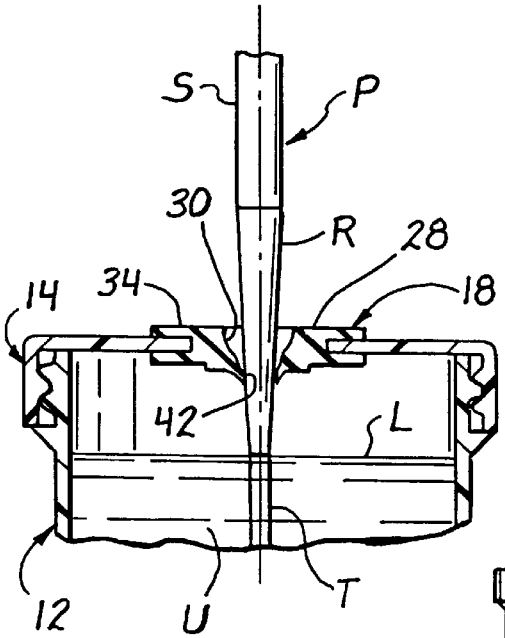
FIG. 3 is a view as in FIG. 2 showing the septum punctured by the plastic transfer pipet of FIG. 1.

If the septum is made with the presently preferred elastomer material, the perforable area of minimum thickness 32 initially tends to stretch substantially as the pipet tip E is pressed against it, eventually reaches the limit of its elasticity and breaks to pass the pipet tip portion T through a tear 42 in the septum 18, as shown in FIG. 3. The size or extent of the resulting tear in the elastomer material of perforable portion 32 is limited by the increased thickness of the immediately surrounding elastomer in the transitional zone 33 of the dimple 30, which instead of tearing distends elastically, when forced to admit and accommodate the increased diameter of the tapering portion R of the pipet or even the diameter of the holding tube S. This may become necessary if the tip end E cannot reach the level L of the specimen fluid U in the container vessel 12.

In the restored or resealed condition the area of minimum thickness 32 has a small tear through its thin elastomeric sheet, but the edges of the tear are brought and held together to essentially reclose the septum against significant fluid flow and leakage. The small size of the tear, the tendency of the septum to close the tear by bringing and holding together the edges of the tear, the relatively small liquid volume of the typical medical specimen, and the natural surface tension of the liquid, all cooperate towards containment of the liquid by the torn septum, in effect restoring the septum to a substantially resealed condition sufficient to contain liquid flow through the septum during normal handling of the specimen container on the premises of the laboratory. When inclined sideways, or even inverted, the torn septum will typically contain the liquid against significant, if any, spillage from the capped specimen container 10.

Generally, the septum is made substantially self-resealing by keeping small the area penetrable by the pipet tip end E and surrounding that area with thicker elastomeric septum material which is not readily puncturable by the pipet tip end E but which contributes sufficient resiliency for reclosing and essentially resealing the tear 42 after the pipet P has been withdrawn from the septum. It should be appreciated that this septum configuration differs from conventional thick septa provided in drug vials and the like, which are intended to be penetrated with the sharp point of a metal needle. Such conventional septa cannot be penetrated by the blunt tip of plastic sampling pipets. It is only because of the particular selection of septum material and the design and construction of the septum structure specifically for this purpose that penetration of a septum with the pipet tip E becomes possible, which is a previously unknown application and use of such sampling pipets and similar sampling implements.

In a presently preferred embodiment of this invention, a 100 milliLiter urine specimen container having a container portion 12 with an inside diameter of about 2 inches and a correspondingly sized cap 14, has a septum 18 with an overall diameter one inch in diameter, including the overlapping portions 22, 24. The septum is supported in a hole 20 which is about ⅝ths of an inch in diameter, such that the thicker peripheral portion 28 of the septum has a similar diameter and is contained in this hole. Dimple 30 is a depression approximately 5/16ths (five sixteenths) of an inch in diameter and approximately hemispherical shape with a ¼ inch radius of curvature of the hemispherical surface. It will be appreciated that the dimple 30 is surrounded by a relatively narrow ring of elastomeric material which itself is radially contained by the circular edge of the hole 20 in the cap 14. This radial containment of the elastomeric material surrounding the dimple contributes to the inward resilience of this material following radial distention caused by insertion of the pipet and aids in restoration of the torn septum to a substantially closed condition.

The thickness of the peripheral portion surrounding the dimple 30 is approximately 3/16ths (three sixteenths) of an inch while the minimum thickness achieved at the perforable central area 32 of the dimple is a few thousands of an inch, for example, about 9/1000ths of an inch (0.009 inch). A presently preferred elastomeric material for septum 18 is commercially available as Kraton and/or TPE Hytrel DuPont Engineering Polymer Grade 5555HS. The invention is not limited to these particular elastomers, and other commercially available elastomers will also be found suitable for this purpose.

The collection and handling of a clinical urine specimen using the specimen container of this invention may be as follows: a container 10 appropriately labeled is handed to a specimen donor at a specimen collection site, e.g. a patient at a doctor's office, who deposits a urine specimen in the open container portion 12. Normally, the donor will also replace the container cap 14 to close the container 10; otherwise the cap is replaced by the attending staff. The attending medical staff then forwards the container 10 with the clinical specimen to a laboratory location for analysis. Receipt of the container 10 is recorded and the container is passed on to laboratory personnel for processing. The laboratory technician takes a single-use soft plastic sampling pipet P and holding the tip portion T between two fingers, e.g. thumb and index finger, presses the tip end E against the puncturable area 32 of the septum 18 until the septum ruptures and the tip section T can be advanced through the resulting hole until the tip end E is immersed in the specimen liquid U. While pressing the tip section against the septum the two fingers can be placed as close to the tip end E as needed to avoid significant lateral bending of the tip portion T under pressure, although a comfortable holding position at about the middle of the tip portion is usually adequate for this purpose. The pipet bulb B is then squeezed to aspirate and draw a sufficient analytical sample into the holding tube S, and the pipet P is withdrawn by pulling the tip end E out of the container 12 and from the hole 42 in the septum, to allow the elastomer making up the septum to return to its initial undistended condition and thereby substantially reseal by closing the hole 42. The quality of the resulting seal may not be equal to that of the original unperforated septum, for such purposes as shipping the specimen container by mail or other common carrier. However, for purposes of storing the specimen container 10 with the remaining specimen liquid on site at the laboratory location, the restored seal has been found to be adequate even after another two or three subsequent insertions of a sampling pipet P through the existing puncture in the perforated septum. However, after the puncture is distended a number of times, typically three or four times, the septum elastomer tends to lose resilience and the quality of the seal effected by the perforated septum deteriorates. The degree of deterioration depends in part on the extent of stretching of the septum material by the pipet, so that better resealing capability may be expected if only the tip portion T is pushed through the septum, while the resealing capability is diminished if the larger diameter tapering section R or the holding tube S are forced through the punctured septum. Still, since only a very small number of repeat samplings of a given urine specimen container are normally needed, such a short service life is acceptable and adequate. In any event, the object of the resealed septum is to substantially prevent spillage of the container contents during normal handling of the container 10 on the laboratory premises, and to retain this capability while drawing a small number of successive analytical samples from the container without removing the container cap.

Figure 4:
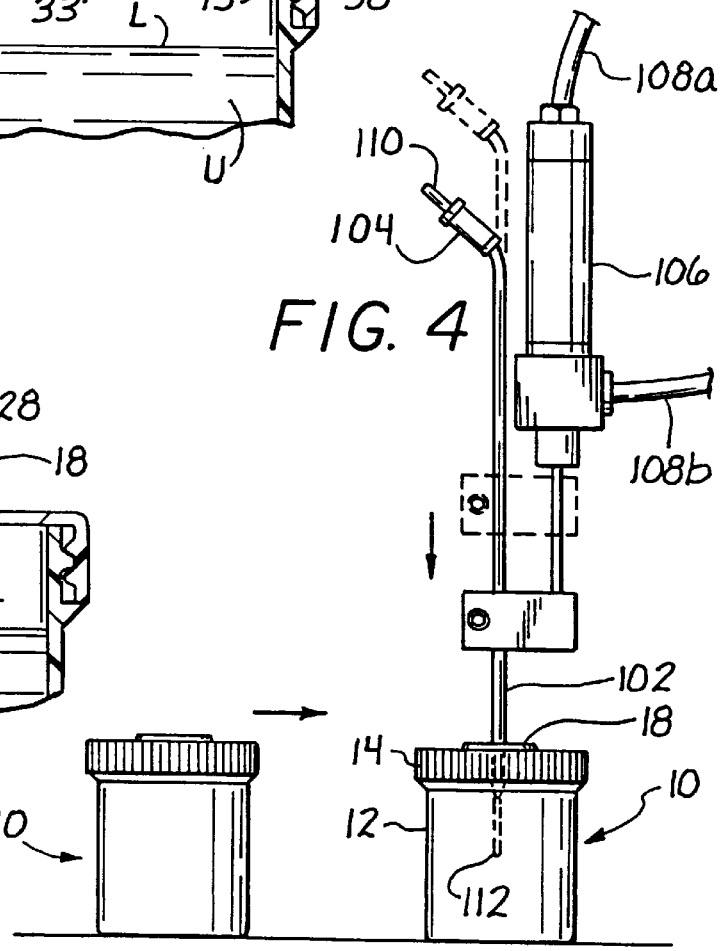
FIG. 4 illustrates a metal pipet of a typical autosampling analyzer driven through the septum of the improved specimen container of FIGS. 1 and 2 for drawing an analytical sample of the clinical specimen.

Yet a further advantage of the improved specimen container 10 is that the same container can be processed in autosampling urine analyzers, which are a recent innovation just now coming into use in clinical laboratories. This equipment is costly and it is expected that in the near future only laboratories with highest volume will make such investment. Smaller laboratories will most likely continue for some time with manual processing of urine specimens as described above. Given this scenario, manufacturers of autosampling urine analyzers have found it commercially expedient to design their machines for compatibility with urine specimen containers in current use. As presently configured, such urine analyzers have a robotic mechanism designed to open the specimen container by removing its cap and reclosing the container after the sample has been drawn, in effect emulating the manual procedure practiced in clinical laboratories lacking automated equipment. A typical pipet assembly of an autosampling clinical analyzer is shown in FIG. 4. A thin metal tube 102 serves as a sampling pipet for drawing the analytical sample from a specimen container 10 into a small reservoir 104. The top end 110 of the pipet is connected to a vacuum line (not shown) for aspirating the analytical sample from the container 10. The lower end of the pipet is not tapered to a needle point; rather, it is cut transversely at a right angle to the length of the pipet tube.

Automated processing of urine samples in such analyzers using the standard, relatively blunt ended metal pipet 102 can be considerably expedited by substituting the improved specimen container 10 for conventional urine specimen containers which lack a septum. The mechanism (not shown in the drawings) which removes and replaces the specimen container caps can be disabled in an existing analyzer, allowing the machine to present the specimen container 10 to the metal pipet with its cap 14 in place. In existing analyzers the metal pipet is lowered into the specimen container by a pneumatic or hydraulic actuator 106, from the phantom lined to the solid lined position in FIG. 4. Actuator 106 normally has sufficient driving force to puncture the minimum thickness at the center 32 of septum 18 of the novel container 10. Use of the novel specimen container 10 consequently shortens the machine cycle of conventional autosamplers by obviating the need for both removal and replacement of the container cap 14.

The containers used for urine specimens, particularly where the urine specimen is to be deposited directly into the container by the specimen donor, have special requirements. The container must have a sufficiently wide mouth opening so that a urine stream can be directed with relative ease, by both male and female donors, into the container. In practice, this calls for a container mouth opening of at least 1.25 inches, and preferably of about two inches or greater in diameter. However, this invention also extends to containers with smaller diameter mouth openings, such as vials and test tubes. FIG. 5 illustrates such an application of this invention in which the peripheral portion 16 of the cap 14 has been eliminated and the entire container cap 50 formed of elastomeric material. In cap 50 the septum is formed integrally with a periphery 28' of the cap, which makes a press fit or otherwise retentively engages the open top 54 of the vial, tube or other narrow mouth container vessel 12". The cap 50 retains the features designated by prime numbers equivalent to elements designated by unprimed numerals in FIGS. 1 through 4, namely a septum 18' with central portion 32' which is readily puncturable by the relatively blunt tip of a single-use soft-plastic laboratory pipet P driven with manual force and surrounded by a peripheral portion 28' not easily puncturable in this manner, the cap 50 being of an elastomeric material selected and configured to be substantially self-resealing following puncture by such a pipet.

It has been found that during urine specimen collection, the specimen donor often fails to tighten the screw-on container cap 14 and this fact may remain unnoticed by the attending medical staff, resulting in leakage of the contents during shipment. This difficulty is considerably diminished by providing a press-fit seal between the container cap 14" and the container vessel 12", such as shown in FIG. 6, particularly if a press-fit closure is provided to ensure positive engagement of the cap. Turning to FIG. 6. The container cap 14" has a raised rim 62 which has an outside diameter sized to make a press-fit with the interior wall surface of the container vessel 12". An annular lip 64 projects radially from the upper edge of the rim 62 and serves to limit how far the cap 14" can be pressed into the container vessel 12". A finger tab 66 extends horizontally from the rim 62 to provide a finger hold when lifting the cap from the container vessel. An interior relatively rigid disk 16' within the rim 62 supports the elastomeric septum 18, which is similar to septum 18 as described in connection with FIGS. 1–3. The press-fit cap 14" more readily shows improper closure than a screw-on cap 14 since the entire circumference of the cap in general and lip 64 in particular is exposed to view. Consequently, improper closure is more easily detected at the specimen collection site before shipment, and can be remedied there to avoid leakage in route. However, the specimen container of this invention is not limited to any particular means of cap engagement, nor to any given size or shape of either the cap or the container vessel.

FIGS. 7 and 8 depict a typical disposable plastic pipetter tip P' used to pierce an alternate elastomeric septum 70, in lieu of the sampling pipette P shown in connection with FIGS. 1 and 3, in order to illustrate the versatility of the specimen container with the novel elastomeric septum. The pipetter tip P' is tubular with a tapering diameter between a relatively wide open upper end U' and an opposite tip end E'. The upper end is sized to make a retentive fit on the lower end of a draw tube D of a conventional pipetter. The tip end E' has a small tip opening through which the liquid sample is drawn up through the tip and into the draw tube D of the pipetter. The open tip end E' is relatively blunt because it is cut perpendicular to the long axis of the tip P' and the generally flat annular end surface of the tip end presents a relatively large cross-sectional area because of the thickness of the plastic tip walls. The transfer pipet and the disposable pipetter tip are illustrative but not exhaustive of the type of sampling implements which can usefully penetrate the elastomeric septum of this invention.

Figure 2:
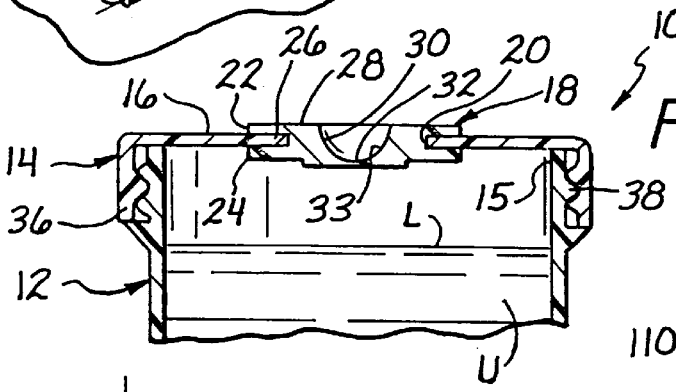
FIG. 2 is a cross-sectional view taken along line 2—2 in FIG. 1 depicting the puncturable septum in the container cap.

In alternate forms of the invention, the puncturable area of the elastomeric septum may be defined by means other than the dished or dimpled area 30 of FIGS. 1–3. For example, as illustrated in FIGS. 7 and 8, the septum 18 is replaced by an elastomeric septum sheet 70 secured to the underside of cap 14'" and in which are made a number of cuts or slits 72 to locally weaken the septum sheet and render the weakened area puncturable by the tip end E' of a disposable plastic pipetter tip P', while retaining a surrounding septum portion 74 of undiminished thickness and strength which supplies restorative resilience tending to reclose the tear in the septum caused by the perforation. The degree of weakening can be controlled, e.g., by the depth of the cuts 72 into the septum sheet thickness, as shown in FIG. 6. For example, a number of short cuts 72, preferably made on the interior surface 75 of the septum sheet and intersecting at a common point in a star configuration can serve this purpose, in lieu of the dimple 30. The septum sheet is weakest at the intersection of the cuts and ruptures at that point when the tip E' of the pipetter tip P' is pressed against the center of the septum, as illustrated in FIG. 7, to admit the pipetter tip into the container 10 by depressing a ring of pointed leaves 76 defined by the cuts 72 and thereby creating an opening at the center of the leaves. When the pipetter tip is withdrawn from the septum, the pointed leaves 76 tend to return to a planar condition, substantially closing the opening in the septum against significant leakage of liquid. The restorative force of the weakened septum sheet may be enhanced by increasing the thickness of the sheet in the area 78 of the cuts 72, while cuts 72 cut through most of that thickness to sufficiently weaken the septum for perforation. The greater thickness increases the stiffness of the leaves 76 and improves their tendency to return to a planar position after perforation and depression.

From the foregoing it is seen that the improved urine specimen container of this invention provides for the first time the capability of processing urine specimens without opening the container, once it has been closed at the specimen collection location, either manually using the conventional plastic sampling pipets or in an autosampling analyzer using the same container. Thus, the improved specimen container 10 offers significant advantages and greater flexibility over existing specimen containers without sacrificing the conventional features of existing urine specimen containers. While primarily directed to a present need in the field of clinical urine analysis, the specimen containers disclosed herein are not limited to use for urine specimens, and can be used with equal advantage for other liquid specimens, medical or non-medical.

While various embodiments of the invention have been disclosed, described and illustrated for purposes of example and clarity, it should be understood that still other changes, modifications and substitutions to the described embodiments, including other septum designs, arrangements and configurations which however are functionally equivalent to those described above, will be apparent to those having ordinary skill in the art without thereby departing from the scope of this invention as defined in the following claims.

What is claimed is:

1. A self-resealing container cap puncturable by a tubular implement having a blunt ended tip of given tip width, comprising:

a cap periphery of relatively inelastic material configured to make closing engagement with a container and an initially unbroken septum of elastomeric material supported in a hole defined in said cap periphery, said septum having an annular outer portion radially contained by said cap periphery and a circular depression centered in said outer portion, said circular depression diminishing in thickness from said outer portion to a central area of minimum thickness, said minimum thickness being less than the thickness of said annular outer portion, said septum being arranged, shaped and sized for returning to a condition substantially sealed against significant leakage of liquid from the container through said septum after said area of minimum thickness is torn by perforation with a blunt ended implement having a tip width substantially greater than said minimum thickness.

2. The container cap of claim 1 wherein said central area of minimum thickness has a minimum thickness of a few thousandths of an inch.

3. The container cap of claim 1 wherein said outer portion and said central area are generally concentrically circular.

4. The container cap of claim 1 wherein said circular depression is a depression of generally spherical curvature.

5. The container cap of claim 1 wherein said circular depression is a generally hemispherical depression in said septum.

6. The container cap of claim 1 wherein said cap periphery is configured for making a press fit with said container.

7. The container cap of claim 1 wherein said cap periphery is configured for making a snap fit with said container.

8. The container cap of claim 1 wherein said cap periphery is threaded for screwing to said container.

9. The container cap of claim 1 wherein said area of minimum thickness has a diameter about equal to or smaller than the tip width of the blunt ended implement such that said annular outer portion is radially compressed against said cap periphery upon insertion of the blunt ended implement through said septum.

10. A self-resealing container cap puncturable by a tubular implement having a blunt ended tip of given tip width, comprising:

a cap periphery of relatively inelastic material configured to make closing engagement with a container and a septum of elastomeric material having a relatively thick outer portion radially contained by said cap periphery, said outer portion having an exterior surface and an interior surface, a dished depression in said exterior surface, said dished depression including a dished surface defining a central area of minimum thickness as measured between said dished surface and said interior surface of the septum, said septum being shaped and sized such that said area of minimum thickness is substantially self-closing by elastically holding together opposite edges of a permanent tear caused by perforation of said area of minimum thickness with a blunt ended implement having a tip width substantially greater than said minimum thickness.

11. The container cap of claim 10 wherein said central area has a diameter generally similar or smaller than the tip width of the said blunt ended implement causing said permanent tear such that said outer portion is elastically compressed against said cap periphery upon insertion of the blunt ended implement through said septum, and upon withdrawal of said implement, the outer portion returns said opposite edges to a substantially closed sealed condition.

12. The container cap of claim 10 wherein said area of minimum thickness is a small portion of said dished surface relative to the total area of the septum.

13. The container cap of claim 10 wherein said dished depression is generally hemispherical.

14. A self-resealing container cap puncturable by a tubular implement having a blunt ended tip of given tip width, comprising:

a cap configured to make closing engagement with a container of a first diameter, a unitary septum of a relatively elastic and compressible elastomeric material supported in said cap, said septum having a generally planar first surface and a concavely dished second surface such that the septum is relatively thick at a radially outer portion and diminishes in thickness towards an area of minimum thickness, said elastomeric material being selected to tear and elastically distend to pass a blunt ended implement having a tip width substantially greater than said minimum thickness through said area of minimum thickness, said elastomeric material being further selected such that the edges of a tear made in said septum by perforation with a blunt ended implement are elastically returned to a substantially closed condition and said first surface restored to a substantially planar condition following withdrawal of the blunt ended implement from the septum.

15. The container cap of claim 14 wherein said area of minimum thickness increases in thickness in a radial direction so as to form a continuously curved cross-section.

16. The container cap of claim 14 wherein said dished second surface is a generally hemispherical cavity and said radially outer portion is of substantially constant thickness around said cavity.

17. The container cap of claim 14 wherein said first surface is an undersurface and said second surface is a top surface.

18. The container cap of claim 14 wherein said cap is of relatively inelastic material.

19. The container cap of claim 14 wherein said area of minimum thickness has a minimum thickness of a few thousandths of an inch.

* * * * *